US007699162B2

(12) United States Patent
Tokarski et al.

(10) Patent No.: US 7,699,162 B2
(45) Date of Patent: Apr. 20, 2010

(54) OPHTHALMIC LENS PACKAGE WITH A FRANGIBLE POUCH AND METHODS OF ITS USE

(76) Inventors: Michael Tokarski, 500 N. Lakewood Run, Ponte Vedra, FL (US) 32082; James Peck, 13587 Osprey Point, Jacksonville, FL (US) 32224; Edward Dzwill, 9 Blossom La., Flemington, NJ (US) 08822; George Brock, 919 Garrison Dr., St. Augustine, FL (US) 32092; Ronald K. Coleman, 354 Piedmont Rd., Columbus, OH (US) 43214

( * ) Notice: Subject to any disclaimer, the term of this patent is extended or adjusted under 35 U.S.C. 154(b) by 138 days.

(21) Appl. No.: 11/526,313

(22) Filed: Sep. 25, 2006
(Under 37 CFR 1.47)

(65) Prior Publication Data

US 2007/0102305 A1 May 10, 2007

Related U.S. Application Data

(60) Provisional application No. 60/721,238, filed on Sep. 28, 2005.

(51) Int. Cl.
*A45C 11/04* (2006.01)

(52) U.S. Cl. ..... 206/5.1; 206/6; 206/438

(58) Field of Classification Search ..... 206/5.1, 206/6, 210, 363, 438, 461, 462, 464, 470
See application file for complete search history.

(56) References Cited

U.S. PATENT DOCUMENTS

| | | | | |
|---|---|---|---|---|
| 5,871,702 | A | 2/1999 | Kutner et al. | |
| 6,286,666 | B1 * | 9/2001 | Umdasch | 206/5.1 |
| 2005/0133382 | A1 * | 6/2005 | Gerard et al. | 206/5.1 |

FOREIGN PATENT DOCUMENTS

| | | |
|---|---|---|
| GB | 2191019 | 12/1987 |
| WO | WO 01/54834 | 8/2001 |

OTHER PUBLICATIONS

PCT International Search Report, dated Apr. 16, 2007, for PCT Int'l. Appln. No. PCT/US2006/037393.

* cited by examiner

*Primary Examiner*—Jila M Mohandesi
*Assistant Examiner*—Sharon M Prange

(57) ABSTRACT

An ophthalmic lens package that contains an ophthalmic lens and its packaging solution including a frangible pouch and side members which contain the packaging solution when the ophthalmic package is opened and methods of using the package.

4 Claims, 4 Drawing Sheets

OPHTHALMIC LENS PACKAGE WITH A FRANGIBLE POUCH AND METHODS OF ITS USE

This application is a non-provisional filing of a provisional application, U.S. Ser. No. 60/721,238, filed on Sep. 28, 2005.

FIELD OF THE INVENTION

The present invention relates to an ophthalmic lens package and, more particularly, to an ophthalmic lens package adapted for improved accessibility to the contents thereof.

BACKGROUND OF THE INVENTION

Ophthalmic lenses, including contact lenses, intra-ocular lenses and overlay lenses and particularly disposable contact lenses, have been conventionally packaged in "blister packs." In general, a blister pack comprises a rigid plastic (e.g., polypropylene), concave-shaped receptacle for receiving an ophthalmic lens and a flexible cover, typically made from a laminate material (such as metal foil), which is removably attached to the receptacle for enclosing the lens therein. Within each blister pack are a single ophthalmic lens and a sufficient amount of contact lens solution to prevent drying of the ophthalmic lens and to maintain the ophthalmic lens readily available for use. While conventional blister packs provide many users with a convenient means for shipping and storing ophthalmic lenses, some users have trouble removing the lens from the contact lens solution and the lenses are damaged during removal from the package. Further, lens can often stick to the inner surface of the laminate and may damaged or lost when users open their packages. Accordingly, there is a need for an ophthalmic lens package that provides user's easy access to its contents on a consistent basis. This need is met by the following invention.

BRIEF DESCRIPTION OF THE DRAWINGS

For a more complete understanding of the present invention, reference is made to the following detailed description of an exemplary embodiment considered in conjunction with the accompanying drawings, in which.

DETAILED DESCRIPTION OF THE INVENTION

The invention includes a package for enclosing an ophthalmic lens comprising, a first side member comprising a first top end and a first bottom end a second side member comprising a second top end and a second bottom end, wherein said first side member and said second side member are pivotally attached at said first bottom end and said second bottom end to allow said first side member and said second side member to pivot between an opened and a closed position a pouch member comprising a first end, a second end, and two breakable side portions, wherein said first end of said pouch member and said first top end of said first member are attached, and said second end of said pouch member and said second top end of said second member are attached, wherein, when said package is closed said two breakable side portions are attached, said first end and said second end are attached to each other, said pouch member is enclosed between said first member and said second member, and said pouch member encloses the ophthalmic lens and its packaging solution wherein, when said package is open, said two breakable side portions separate, said first end and said second end separate from each other and the ophthalmic lens contained within said pouch is presented to a user.

Figure 1:
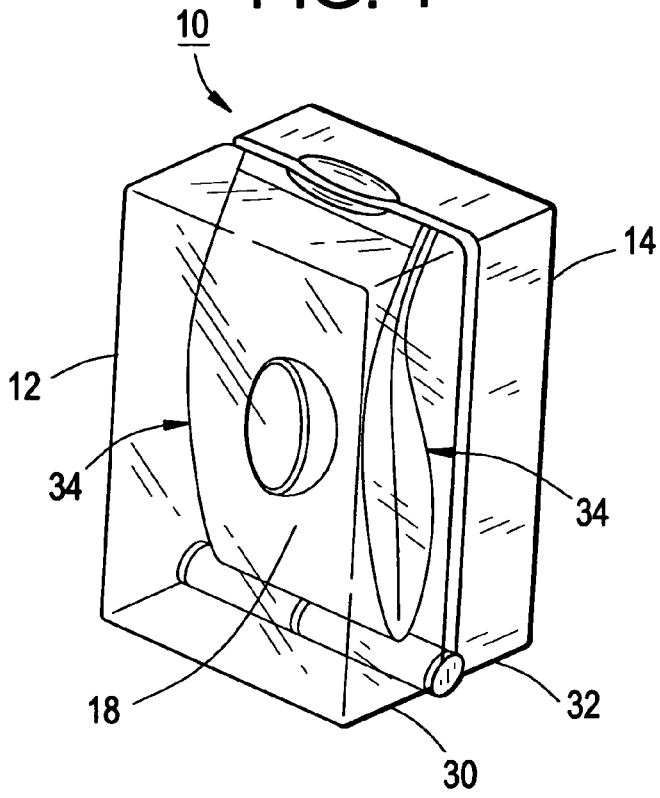
FIG. 1 is a perspective view of a closed ophthalmic lens package constructed in accordance with an exemplary embodiment of the present invention.
Figure 2:
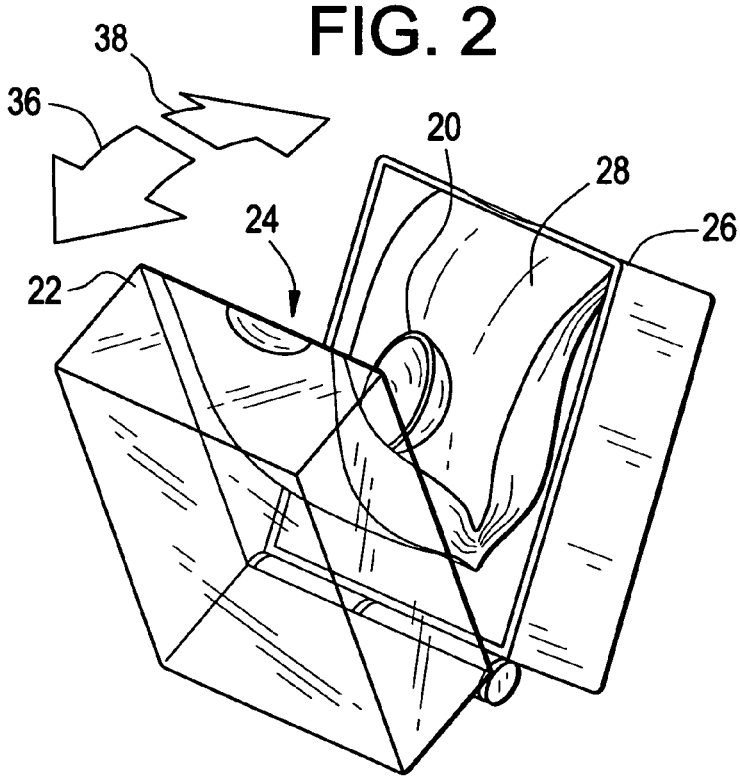
FIG. 2 is a perspective view of an opened ophthalmic lens package of FIG. 1.
Figure 3A:
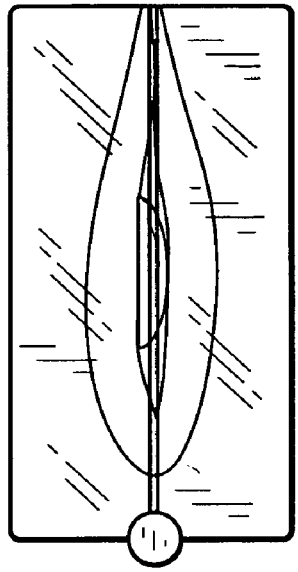
FIG. 3*a*, 3*b* is a side view of a closed and an opened ophthalmic package of FIG. 1.
Figure 3B:
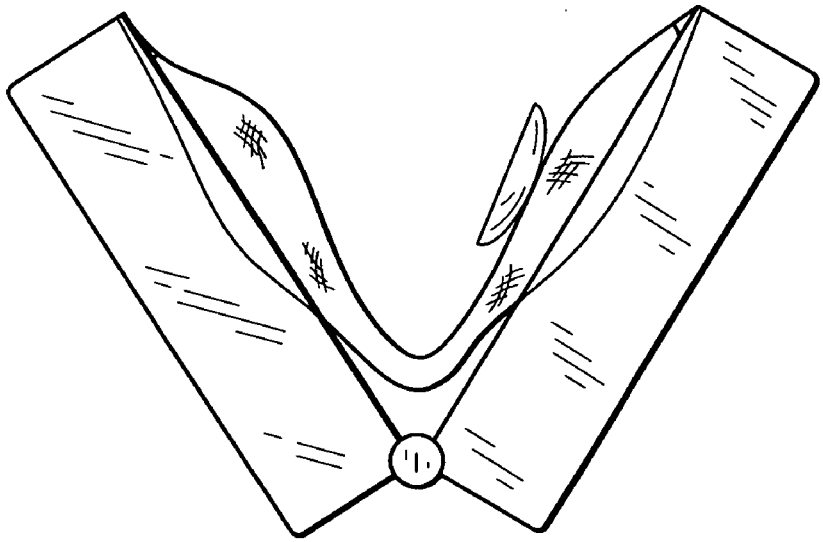
Figure 4:
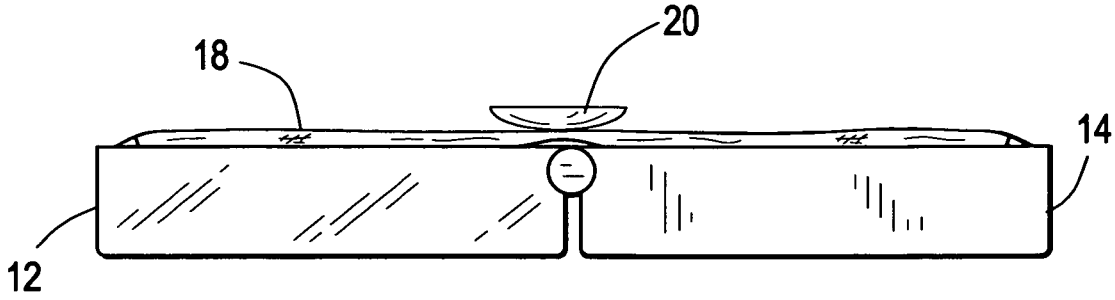
FIG. 4 is a side view of an opened ophthalmic lens package of FIG. 1

FIGS. 1, 2 and 3 illustrate an ophthalmic lens package 10 includes a first side member 12 a second side member 14, pouch 18 containing contact lens 20 and its packaging solution (not shown). First side member 12 is pivotally attached to side member 14 at first bottom end 30 and second bottom end 32. Each of the depicted first and second side members are rectangular cavities, however any shape is appropriate. It is preferred that each side has a cavity for containing the packaging solution that is released when pouch 18 is opened. However, it is contemplated that side members could be flat pieces which contain an absorbent member to contain packaging solution released from the pouch upon opening. Referring to FIGS. 1, 2, and 3*a*, when package 10 is closed, first end 24 and second end 28 are attached and two breakable sides 34 are attached to enclose contact lens 20 in its solution. In addition, to being attached to each other, in the closed positions, first end 24 and second end 28 are attached to first top end 22 and second top end 26, respectively. First top end 22 and second top end 26 are close to one another and are preferably sealed to each other in the closed position. FIG. 2 illustrates a partially opened package. The package is pivotally opened in the direction indicated by arrows 36 and 38. First end 24, second end 28, and two breakable sides 34 separate as the pouch opens to reveal the ophthalmic lens. FIG. 4 depicts a fully opened package, some or all of the packaging solution spills from the pouch upon opening and is contained with said first and second side members. Ophthalmic lens 20 is presented on the opened pouch to the user, for insertion.

As used herein, "ophthalmic lens" refer to a device that resides on the eye, including but not limited to soft contact, lenses, hard contact lenses, intraocular lenses, overlay lenses, preferably soft contact lenses. Pouch 18 may be manufactured from flexible materials, such as a combination of polymers with various barrier and sealing characteristics formed into a laminate or co-extrusion materials. Two breakable sides 34, may be formed of different materials from the rest of the pouch, that material tears when pouch 18 is opened. It is preferably that pouch 18 is transparent, but not necessary. When the package is closed first end 22 and second end 26 are sealed to prevent the loss or evaporation of the solution from the package 10 and to prevent contamination of the contents thereof from foreign objects such as debris and dirt particles. The preferred method of sealing the surface is heat sealing. Alternatively, other sealing means, such as adhesives, induction sealing or sonic welding, may be utilized. First top end and second top end, may be sealed in this manner, or by use of an external tape or other mechanism.

Packaging solutions for the ophthalmic lenses include but are not limited to saline solution, water or buffered aqueous solutions, and the preferred solution is aqueous saline solution. The packaging solution is present in a quantity sufficient to keep the ophthalmic lens saturated to retain its intended shape (i.e. convex shape) and softness when release from package 10. First and second Side members may be prepared form polymers that may be formed into a rigid shape. It is preferable that such polymers are transparent, to that the used can see through the member to the internal pouch.

Further the invention includes a package for enclosing an ophthalmic lens comprising, a first side member comprising a first top end and a first bottom end a second side member comprising a second top end and a second bottom end, wherein said first side member and said second side member are pivotally attached at said first bottom end and said second bottom end to allow said first side member and said second side member to pivot between an opened and a closed position a pouch member comprising a first end, a second end, two sealing areas, and two breakable side portions, wherein said first end of said pouch member and said first top end of said first member are attached, and said second end of said pouch member and said second top end of said second member are attached, wherein, when said package is closed said two breakable side portions are attached, said two sealing areas are attached to each other, said pouch member is enclosed between said first member and said second member, and said pouch member encloses the ophthalmic lens and its packaging solution wherein, when said package is open, said two breakable side portions separate, said two sealing areas separate from each other and the ophthalmic lens contained within said pouch is presented to a user.

Figure 5:
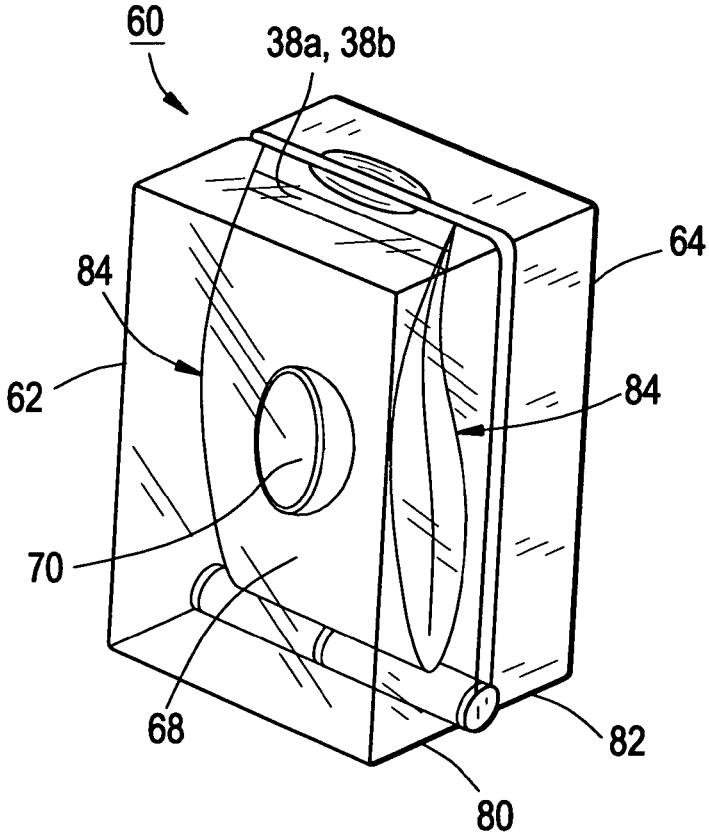
FIG. 5 is a perspective view of a closed ophthalmic lens package constructed in accordance with an exemplary embodiment of the present invention.
Figure 6:
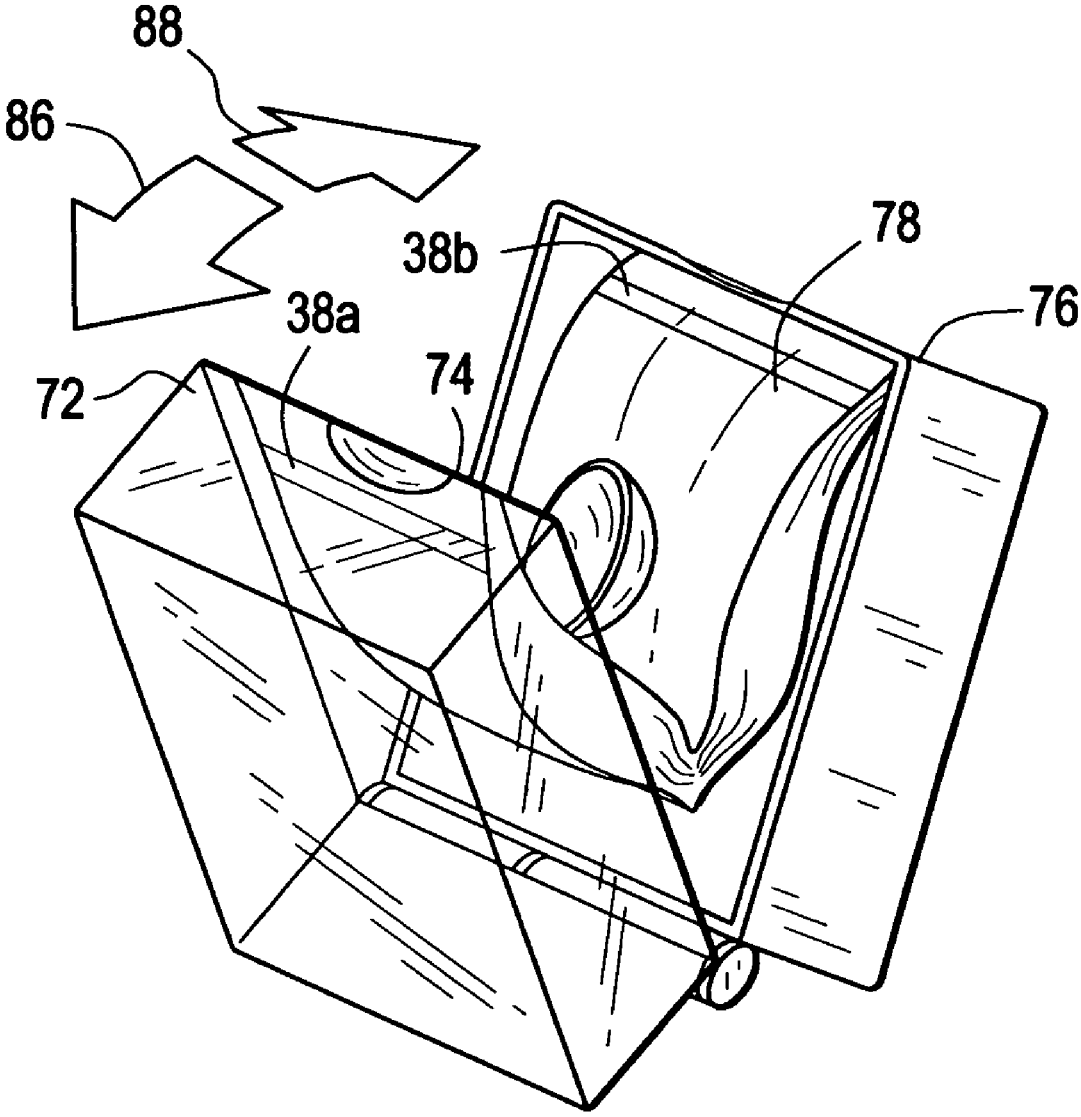
FIG. 6 is a perspective view of the opened ophthalmic lens package of FIG. 5.

FIGS. 5 and 6. illustrate an ophthalmic lens package 60 includes a first side member 62 a second side member 64, pouch 68 containing contact lens 70 and its packaging solution (not shown). First side member 62 is pivotally attached to side member 64 at first bottom end 80 and second bottom end 82. Each of the depicted first and second side members are rectangular cavities, however any shape is appropriate. It is preferred that each side has a cavity for containing the packaging solution that is released when pouch 68 is opened. However, it is contemplated that side members could be flat pieces which contain an absorbent member to contain packaging solution released from the pouch upon opening. Referring to FIG. 5 when package 60 is closed, sealing areas 38*a* and 38*b* are attached and two breakable sides 84 are attached to enclose contact lens 70 in its solution. Sealing areas 38*a* and 38*b* may be sealed by any of methods mentioned above. First end 74 and second end 78 are attached to first top end 72 and second top end 76, respectively by any of the methods mentioned above. First top end 72 and second top end 76 are close to one another and are preferably sealed to each other in the closed position. FIG. 6 illustrates a partially opened package. The package is pivotally opened in the direction indicated by arrows 86 and 88. Sealing areas 38*a* and 38*b* and two breakable sides 84 separate as the pouch opens to reveal the ophthalmic lens. First end 74 and second end 78 remain attached to first top end 72 and second top end 76, respectively.

The invention includes a method of packaging an ophthalmic lens comprising inserting an ophthalmic lens and its packaging solution into a pouch member of a package comprising, a first side member comprising a first top end and a first bottom end a second side member comprising a second top end and a second bottom end, wherein said first side member and said second side member are pivotally attached at said first bottom end and said second bottom end to allow said first side member and said second side member to pivot between an opened and a closed position a pouch member comprising a first end, a second end, and two breakable side portions, sealing said first end of said pouch member to said first top end of said first member, and said second end of said pouch member to said second top end of said second member and, sealing said first end and said second end of said pouch member to each other.

Still further the invention includes a method for packaging an ophthalmic lens comprising inserting the ophthalmic lens and its packaging solution into the pouch member of a package comprising, a first side member comprising a first top end and a first bottom end a second side member comprising a second top end and a second bottom end, wherein said first side member and said second side member are pivotally attached at said first bottom end and said second bottom end to allow said first side member and said second side member to pivot between an opened and a closed position a pouch member comprising a first end, a second end, two sealing areas, and two breakable side portions, sealing said two sealing areas, and sealing said first end of said pouch member to said first top end of said first member and said second end of said pouch member to said second top end of said second member.

Further the invention includes a method of inserting an ophthalmic lens into the eye of a user comprising opening a package comprising a first side member comprising a first top end and a first bottom end a second side member comprising a second top end and a second bottom end, wherein said first side member and said second side member are pivotally attached at said first bottom end and said second bottom end to allow said first side member and said second side member to pivot between an opened and a closed position a pouch member comprising a first end, a second end, and two breakable side portions, wherein said first end of said pouch member and said first top end of said first member are attached, and said second end of said pouch member and said second top end of said second member are attached, wherein, when said package is closed said two breakable side portions are attached, said first end and said second end are attached to each other, said pouch member is enclosed between said first member and said second member, and said pouch member encloses the ophthalmic lens and its packaging solution wherein, when said package is open, said two breakable side portions separate, said first end and said second end separate from each other and the ophthalmic lens contained within said pouch is presented to a user, and inserting said ophthalmic lens into the user's eye.

Yet still further, the invention includes a method of inserting an ophthalmic lens into the eye of a user comprising opening a package comprising a first side member comprising a first top end and a first bottom end a second side member comprising a second top end and a second bottom end, wherein said first side member and said second side member are pivotally attached at said first bottom end and said second bottom end to allow said first side member and said second side member to pivot between an opened and a closed position a pouch member comprising a first end, a second end, two sealing areas, and two breakable side portions, wherein said first end of said pouch member and said first top end of said first member are attached, and said second end of said pouch member and said second top end of said second member are attached, wherein, when said package is closed said two breakable side portions are attached, said two sealing areas are attached to each other, and said pouch member is enclosed between said first member and said second member and said pouch member encloses the ophthalmic lens and its packaging solution wherein, when said package is open, said two breakable side portions separate, said two sealing areas separate from each other and the ophthalmic lens contained within said pouch is presented to a user, and inserting said ophthalmic lens into the user's eye.

It will be understood that the embodiments described herein is merely exemplary and that a person skilled in the art may make many variations and modifications without departing from the spirit and scope of the invention. Specifically, the present invention has been adapted for use in housing a single ophthalmic lens and an amount of solution. However, the present invention can be utilized to house a plurality of ophthalmic lenses and an amount of solution therefor. Further features and advantages of the invention will appear more clearly on a reading of the detailed description of an exemplary embodiment of the invention, which is given below by way of example only with reference to the accompanying drawings. All such variations and modifications are intended to be included within the scope of the invention as defined in the appended claims.

What is claimed is:

1. A package for enclosing an ophthalmic lens comprising, a first side member comprising a first top end and a first bottom end a second side member comprising a second top end and a second bottom end, wherein said first side member and said second side member are pivotally attached at said first bottom end and said second bottom end to allow said first side member and said second side member to pivot between an opened and a closed position a pouch member comprising a first end, a second end, two sealing areas, two breakable side portions enclosing, an ophthalmic lens and packaging solution, wherein said packaging solution is a quantity sufficient to keep the ophthalmic lens saturated to retain its intended shape, wherein said first end of said pouch member and said first top end of said first member are attached in both the opened and the closed positions, and said second end of said pouch member and said second top end of said second member are attached in both the opened and the closed positions, wherein, when said package is closed said two breakable side portions are attached, said two sealing areas are attached to each other, said pouch member is enclosed between said first member and said second member, and said pouch member encloses the ophthalmic lens and the packaging solution wherein, when said package is open, said two breakable side portions separate, said two sealing areas separate from each other and the ophthalmic lens contained within said pouch is presented to a user wherein said first side member and said second side member are rectangular cavities wherein when said first side member and said second side member are opened the packaging solution is released and contained within said first side member and said second side member.

2. The package of claim 1 further comprising printed or illustrated instructions of how to open said package.

3. The package of claim 1 further comprising printed or illustrated instructions of how to open said package and insert the ophthalmic lens.

4. A method of inserting an ophthalmic lens into the eye of a user comprising opening a package comprising a first side member comprising a first top end and a first bottom end a second side member comprising a second top end and a second bottom end, wherein said first side member and said second side member are pivotally attached at said first bottom end and said second bottom end to allow said first side member and said second side member to pivot between an opened and a closed position a pouch member comprising a first end, a second end, two sealing areas, and two breakable side portions, enclosing, an ophthalmic lens and packaging solution, wherein said packaging solution is a quantity sufficient to keep the ophthalmic lens saturated to retain its intended shape, wherein said first end of said pouch member and said first top end of said first member are attached in both the opened and the closed positions, and said second end of said pouch member and said second top end of said second member are attached in both the opened and the closed positions, wherein, when said package is closed said two breakable side portions are attached, said two sealing areas are attached to each other, and said pouch member is enclosed between said first member and said second member wherein, when said package is open, said two breakable side portions separate, said two sealing areas separate from each other and the ophthalmic lens contained within said pouch is presented to a user, wherein said first side member and said second side member are rectangular cavities wherein when said first side member and said second side member are opened the packaging solution is released and contained within said first side member and said second side member.

* * * * *